US007159338B2

(12) United States Patent
LeVert et al.

(10) Patent No.: US 7,159,338 B2
(45) Date of Patent: Jan. 9, 2007

(54) FLUID FLOW SYSTEM FOR SPRING-CUSHIONED SHOE

(76) Inventors: Francis E. LeVert, 1909 Matthew La., Knoxville, TN (US) 37923; David S. Krafsur, 4330 Crane Ct., Loveland, CO (US) 80537

( * ) Notice: Subject to any disclaimer, the term of this patent is extended or adjusted under 35 U.S.C. 154(b) by 0 days.

(21) Appl. No.: 11/047,446

(22) Filed: Jan. 31, 2005

(65) Prior Publication Data

US 2005/0126040 A1 Jun. 16, 2005

Related U.S. Application Data

(62) Division of application No. 10/436,935, filed on May 14, 2003, now Pat. No. 6,865,824, which is a division of application No. 09/982,520, filed on Oct. 18, 2001, now Pat. No. 6,665,957.

(60) Provisional application No. 60/241,547, filed on Oct. 19, 2000.

(51) Int. Cl.
*A43B 13/28* (2006.01)

(52) U.S. Cl. ..... 36/27; 36/28; 36/29

(58) Field of Classification Search ..... 36/27, 36/28, 29, 3 B

See application file for complete search history.

(56) References Cited

U.S. PATENT DOCUMENTS

| | | | |
|---|---|---|---|
| 1,380,879 | A | 6/1921 | Young |
| 1,469,920 | A | 10/1923 | Dutchak |
| 1,502,087 | A | 7/1924 | Bunns |
| 1,675,256 | A | 6/1928 | Crosthwait |
| 1,942,312 | A | 1/1934 | Tutoky |
| 2,334,719 | A | 11/1943 | Margolin |
| 2,444,865 | A | 7/1948 | Warrington |
| 2,447,603 | A | 8/1948 | Snyder |
| 2,535,102 | A | 12/1950 | Taylor |
| 2,668,374 | A | 2/1954 | Seigle |
| 2,669,038 | A | 2/1954 | De Werth |
| 2,720,041 | A | 10/1955 | Kajtar |
| 3,050,875 | A | 8/1962 | Robbins |
| 3,225,463 | A | 12/1965 | Burnham |
| 3,702,999 | A | 11/1972 | Gradisar |
| 3,791,375 | A | 2/1974 | Pfeiffer |
| 3,822,490 | A | 7/1974 | Murawski |
| 4,267,648 | A | 5/1981 | Weisz |
| 4,414,760 | A | 11/1983 | Faiella |
| 4,446,634 | A | 5/1984 | Johnson et al. |
| 4,458,430 | A | 7/1984 | Peterson |
| 4,492,046 | A | 1/1985 | Kosova |
| 4,592,153 | A | 6/1986 | Jacinto |
| 4,638,575 | A | 1/1987 | Illustrato |
| 4,715,130 | A | 12/1987 | Scatena |
| 4,815,221 | A | 3/1989 | Diaz |
| 4,843,737 | A | 7/1989 | Vorderer |
| 4,894,933 | A | 1/1990 | Tonkel et al. |
| 4,901,987 | A | 2/1990 | Greenhill et al. |
| 4,910,884 | A | 3/1990 | Lindh et al. |
| 5,068,981 | A | 12/1991 | Jung |
| 5,138,776 | A | 8/1992 | Levin |
| 5,224,278 | A | 7/1993 | Jeon |
| 5,269,081 | A | 12/1993 | Gray |

(Continued)

*Primary Examiner*—Ted Kavanaugh
(74) *Attorney, Agent, or Firm*—Pitts & Brittian, P.C.

(57) ABSTRACT

A fluid flow system for a spring-cushioned shoe is disclosed. The sole of the shoe includes a vacuity, a spring disposed within the vacuity, and a fluid passageway in fluid communication with the vacuity. The fluid flow passageway allows fluid, such as air, to escape the vacuity when the volume of the vacuity is reduced during a foot strike.

6 Claims, 3 Drawing Sheets

U.S. PATENT DOCUMENTS 5,282,324 A 2/1994 Cheng
5,337,492 A 8/1994 Anderie et al.
5,343,636 A 9/1994 Sabol
5,353,525 A 10/1994 Grim
5,369,896 A 12/1994 Frachey et al.
5,435,079 A 7/1995 Gallegos
5,437,110 A 8/1995 Goldston et al.
5,502,901 A 4/1996 Brown
5,511,324 A 4/1996 Smith
5,513,448 A 5/1996 Lyons
5,517,769 A 5/1996 Zhao
5,528,842 A 6/1996 Ricci et al.
5,544,431 A 8/1996 Dixon
5,560,126 A 10/1996 Meschan et al.
5,595,002 A 1/1997 Slepian et al.
5,639,074 A 6/1997 Greenhill et al.
5,649,374 A 7/1997 Chou
5,651,196 A 7/1997 Hsieh
5,671,552 A 9/1997 Pettibone et al.
5,706,589 A 1/1998 Marc
5,743,028 A 4/1998 Lombardino
5,832,629 A 11/1998 Wen
5,860,225 A 1/1999 O'Dwyer
5,875,567 A 3/1999 Bayley
5,896,679 A 4/1999 Baldwin
5,916,071 A 6/1999 Lee
6,006,449 A 12/1999 Orlowski et al.
6,079,123 A 6/2000 Clark
6,282,814 B1 9/2001 Krafsur et al.
6,665,957 B1 12/2003 LeVert et al.
6,865,824 B1 3/2005 LeVert et al.

FLUID FLOW SYSTEM FOR SPRING-CUSHIONED SHOE

CROSS-REFERENCE TO RELATED APPLICATIONS

This is a division of application Ser. No. 10/436,935 filed May 14, 2003 now U.S. Pat. No. 6,865,824, which was a division of application Ser. No. 09/982,520, filed Oct. 18, 2001, and issued Dec. 23, 2003, as U.S. Pat. No. 6,665,957 which, pursuant to 35 U.S.C. § 119, claims the benefit of U.S. Provisional Application No. 60/241,547, filed Oct. 19, 2000.

STATEMENT REGARDING FEDERALLY SPONSORED RESEARCH OR DEVELOPMENT

This invention relates to the field of shoes, and in particular, spring-cushioned shoes.

BACKGROUND OF THE INVENTION

In most running, walking, and jumping activities, the return force resulting from foot strikes causes great shock to the body. The stress from repeated foot strikes places great stress on joints and bones, and can cause injuries to the lower back and the rotating joints of the legs.

To minimize injury to the body resulting from repeated foot strikes, and also to improve athletic performance, shoe engineers have designed various spring-cushioned shoes. The springs in spring-cushioned shoes are designed to reduce shock to the body during a foot strike, and also to recover and return impact energy to the user. One type of spring-cushioned shoe is described in U.S. Pat. No. 6,282,814 to Krafsur et al., which is incorporated herein by reference. Two other types of spring-cushioned shoes are described in U.S. Pat. No. 5,743,028 to Lombardino, and U.S. Pat. No. 4,815,221 to Diaz. The Lombardino '028 patent discloses a plurality of vertical compression springs located in the heel area of a running shoe. The springs of the '028 patent are housed in a hermetically sealed unit filled with a pressurized gas which in combination with the springs provides a shock absorption and energy return system. The Diaz '221 patent discloses an energy control system placed within a cavity in the sole of a shoe. The energy control system includes a spring plate with a plurality of spring projections distributed over the surface of the plate for propulsion and shock absorption.

BRIEF SUMMARY OF THE INVENTION

In the spring-cushioned shoe designs of the patents described above, the springs are sealed within vacuities formed in the soles of the shoe. When the springs are sealed within a vacuity, the air within the vacuity is an integral part of the spring system. During a foot strike, air sealed within the vacuities behaves according to the ideal gas law, PV=nRT, which states that the pressure of the air within the cavity, at a substantially constant temperature, varies inversely with the volume as the cavity is compressed. During a foot strike, therefore, the air exerts a return force as the volume of the cavity decreases. This return force exerted by the air interferes with the predictable return force exerted by the spring in response to a foot strike.

Thus, while trapped air in a shoe sole is thought to be desirable because the air provides cushioning and return force, in spring-cushioned shoes, the air interferes with the predictable operation of the spring.

Accordingly, it is an object of the invention to provide a fluid flow system as a part of a spring-cushioned shoe sole assembly that will reduce the spring-like reaction force of the fluid within a vacuity that contains a spring or springs.

A second object of the invention is to provide a spring-cushioned shoe sole assembly that returns, by way of the spring force, a substantial portion of the energy stored in the springs during the initial compression cycle of the heel or ball area of the foot.

In one aspect, the invention features a shoe that includes a shoe sole which defines a vacuity, a spring disposed within the vacuity, and a fluid passageway in fluid communication with the vacuity. The passageway is configured to allow evacuation of fluid from the vacuity upon a reduction in the volume of the vacuity.

Embodiments of this aspect of the invention may include one or more of the following features. The vacuity can be disposed within the heel region of the shoe sole, and the spring can be mounted within the vacuity between a pair of vertically opposed plates, disposed on upper and lower ends of the vacuity.

The sole can define a second vacuity, e.g., in the ball region, that may or may not include a spring, connected to the first vacuity by the fluid passageway. The two vacuities and the fluid passageway can be hermetically sealed from the exterior of the shoe, trapping fluid, such as ambient air, inside the vacuities. Trapped air can be sealed at atmospheric pressure, or at less than atmospheric pressure.

The fluid passageway may also include a channel that connects the vacuity to the exterior of the shoe, allowing evacuation of fluid to the exterior of the shoe upon reduction in volume of the vacuity.

The shoe sole may include an inner sole, a mid-sole, and an outer sole, where the mid-sole defines the vacuity. The mid-sole can be formed entirely from a compressible foamed polymeric material, or from, e.g., a foamed polymeric material and a flexible plastic material, where the flexible plastic material defines at least a portion of a wall of the vacuity. The spring can be, e.g., a crest-to-crest multi-turn wave spring.

In another aspect, the invention features a shoe sole assembly. The sole assembly includes a compressible material defining a vacuity, a spring disposed within the vacuity, and a fluid passageway in fluid communication with the vacuity. The passageway is configured to allow evacuation of fluid from the vacuity upon compression of the vacuity.

In another aspect, the invention features a method of manufacturing a spring-cushioned shoe sole assembly. The method includes: (a) forming at least a portion of the sole assembly from a compressible material, where the portion defines a vacuity; (b) disposing a spring within the vacuity; and (c) forming a fluid passageway in fluid communication with the vacuity, the passageway allowing fluid to escape from the vacuity upon compression of the vacuity.

As used herein, "fluid" means a substance that flows, such as a gas or a liquid. Ambient air is a fluid.

A "spring" is a resilient mechanical device that recovers its original shape when released after being distorted. A "compression spring" is a spring that is loaded (i.e., distorted) by compression. Types of compression springs include, for example: wave springs, such as nested wave springs, interlaced wave springs, and crest-to-crest wave springs (with or without shim ends); disc springs; Belleville springs; compound Belleville springs; spiral springs; and helical springs.

A "multi-turn spring" is a spring having multiple "turns," where a turn is a revolution of the spring.

The details of several embodiments of the invention are set forth in the accompanying drawings and the description below. Other features, objects, and advantages of the invention will be apparent from the description and drawings, and from the claims.

DETAILED DESCRIPTION OF THE INVENTION

By way of example, several embodiments of the invention are described below.

The First Embodiment

Figure 1:
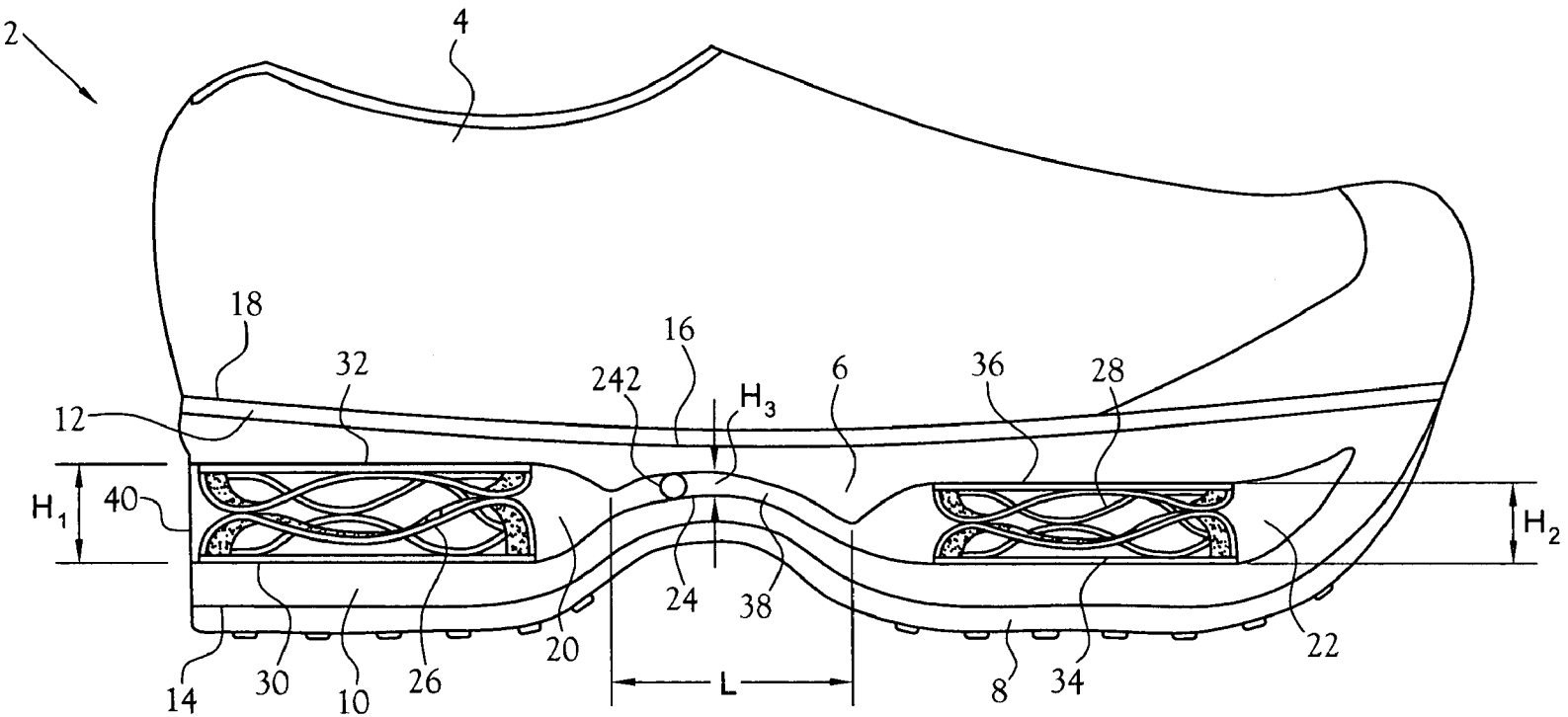
FIG. 1 is a cross sectional side view of a spring-cushioned shoe according to the present invention.

FIG. 1 shows a spring-cushioned shoe 2 that includes an upper shoe portion 4 and a fluid shifting sole assembly 6 ("FSSA 6"). FSSA 6 includes an outer sole 8, a mid-sole 10 and an inner sole 12. Mid-sole 8 has lower and upper surfaces 14 and 16, respectively. Lower surface 14 is adhesively attached to outer sole 8, and upper surface 16 is adhesively attached to inner sole 12. Inner sole 12 has a contact surface 18 for upper shoe portion 4.

FSSA 6 defines vacuities 20 and 22, positioned in the heel and ball of the foot areas of FSSA 6, respectively. Vacuities 20 and 22 are enclosed within mid-sole 10. Fluid flow passageway 24, also enclosed within mid-sole 10, connects vacuities 20 and 22. Passageway 24 is curved slightly, to track the contour of the FSSA 6.

Compression springs 26 and 28 are mounted within vacuities 20 and 22, respectively. Spring 26 is located between two vertically opposed polymeric structured plates 30 and 32, which define the vertical extent of vacuity 20. Plates 30 and 32 have protrusive elements (not shown in FIG. 1) that extend toward the vertical midline of vacuity 20, and limit the total compression of compression spring 26. Plates 30 and 32 provide bearing surfaces that transfer the load from the foot to compression spring 26 and also prevent the full collapse of the spring under load. The structure of plates 30 and 32, and the compression limiting protrusive elements, are shown and described in U.S. Pat. No. 6,282,814. Spring 26 and plates 30 and 32 may be inserted into vacuity 20 as an assembled unit.

Similarly, spring 28 is located between vertically opposed polymeric structured plates 34 and 36, which define the vertical extent of vacuity 22. Plates 34 and 36 provide bearing surfaces for the transfer of the load from the foot to compression spring 28 and, like plates 30 and 32, have compression limiters that prevent full collapse of spring 28 under load. Spring 28 and plates 34 and 36 may be inserted into vacuity 22 as an assembled unit.

A fluid, indicated by numeral 38, is contained within vacuities 20 and 22 and passageway 24. In FSSA 6, the fluid is ambient air. Other types of fluids, such as mixed or pure gasses or a liquid, can also be used. Vacuity 20 has a height $H_1$ of, e.g., about 0.75 inches, and vacuity 22 has a height $H_2$ of, e.g., about 0.5 inches. The cross-sectional area of vacuity 20, taken along height $H_1$, is, e.g., about eight square inches, and the cross-sectional area of vacuity 22, taken along height $H_1$, is, e.g., about twelve square inches. The volume of vacuity 20 is, e.g., about six cubic inches, and the volume of vacuity 22 is also, e.g., about six cubic inches.

Passageway 24 has a generally rectangular cross-section with a width of, e.g., about 1.75 inches, and a height $H_3$ of, e.g., about 0.5 inches. The cross-sectional area of passageway 24, taken along the height $H_3$, is, e.g., about 0.85 square inches, and the length L of passageway 24 is, e.g., about four inches. Passageway 24 has a volume of, e.g., about 3.4 cubic inches. Passageway 24 could also be designed to have a volume that is half the volume of each vacuity (e.g., three cubic inches), or less than half the volume of each vacuity (e.g., 2.5 cubic inches).

Vacuities 20 and 22 and passageway 24 of FSSA 6 are hermetically sealed from the outside environment at atmospheric pressure, to prevent air exchange between the vacuities and the exterior of the shoe, and to limit the amount of moisture and small particles that enter the vacuities. Sealing is accomplished, e.g., by adhesively attaching inner sole 12 to second surface 16.

In order to minimize resistance to flow of fluid 38 during a foot strike, the volume of vacuity 20 is substantially smaller than the combined volume of vacuity 22 and passageway 24. Similarly, the volume of vacuity 22 is substantially smaller than the combined volume of vacuity 20 and passageway 24.

Mid-sole 10, with the exception of a small rear section 40 of the mid-sole, is composed entirely of, e.g., a compressible foamed polymeric material. Rear section 40, which defines the rear wall of vacuity 20, is made from a transparent flexible plastic material. Rear section 40 acts as a flexible window, allowing a user to see the spring 26 inside of vacuity 20. Alternatively, the entire mid-sole 10 can be formed from the compressible foamed polymeric material, and the flexible window can be eliminated.

In addition, more of mid-sole than just rear section 40 can be made from the flexible clear plastic. For example, the flexible plastic can define the side walls of both vacuity 20 and vacuity 24. If the side walls of both vacuities are formed, at least in part, from the flexible plastic, rather than the polymeric foam, then the polymeric foam can be rigid, rather than compressible. A rigid material would be possible because, if flexible plastic forms the side walls of both vacuities, then the vacuities can be compressed and reduced in volume even if the material forming the rest of the mid-sole is rigid.

Inner sole 12 is, e.g., a nonwoven material, and outer sole 8 is composed of, e.g., ethyl vinyl acetate. Numerous other materials may also be used for mid-sole 10, inner sole 12, and outer sole 8. The upper shoe portion 4 can be fabric, leather, or any combination of suitable footwear materials.

Compression springs 26 and 28 are multi-turn crest-to-crest wave springs, without shim ends, made of flat wire steel.

The operation of FSSA 6 during a foot strike will now be explained. In most running, walking, and jumping events, the foot follows a prescribed set of motions. The heel impacts the ground first, the weight then shifts forward onto the ball of the foot in a rolling manner, and the toe region provides the last contact with the ground. When the heel of a shoe containing FSSA 6 impacts an essentially rigid surface, the heel region of FSSA 6 and vacuity 20 are compressed, such that the height of vacuity 20 is reduced by, e.g., about 0.5 inches. This compression reduces the volume of vacuity 20, and loads spring 26. The reduction in volume of vacuity 20 causes an essentially instantaneous movement of fluid 38, with minimal flow resistance, from vacuity 20 into passageway 24 and into vacuity 22. The eructative evacuation of fluid 38 from vacuity 20 prevents fluid 38 from interfering with the predictable operation of spring 26, and allows spring 26 to provide substantially all of the spring force.

As the foot rolls forward onto the ball region, vacuity 20 returns to its resting volume. Once the weight of the foot is over the ball region, the ball region of FSSA 6 and vacuity 22 are compressed, loading spring 28 and reducing the volume of vacuity 22. The reduction in volume of vacuity 22 causes an essentially instantaneous movement of fluid 38, with minimal flow resistance, from vacuity 22 into passageway 24 and into vacuity 20. As with the heel strike, the eructative evacuation of fluid from vacuity 22 prevents the fluid from interfering with the predictable operation of spring 28, and allows spring 28 to provide substantially all of the spring force to the ball of the foot. When the weight is lifted from the ball of the foot, the volume of vacuity 22 returns to normal, and fluid flows back into vacuity 22. The movement of fluid 38 between vacuities 20 and 22, through passageway 24, repeats cyclically over repeating rolling foot strikes.

The fluid flow system of FSSA 6 improves the predictability and performance of a spring-cushioned shoe. According to the ideal gas law, if there is no passageway allowing the eructative escape of air from a compressed vacuity to the surrounding environment, the spring in the vacuity and the air in the vacuity cooperate to produce an effective spring force, which is greater than that of the spring acting alone. The spring effect of the air is less predictable and less controllable than the return force provided by the spring itself, and therefore can diminish performance of the shoe. In FSSA 6, the movement of fluid 38 back and forth between the vacuities 20 and 22, through passageway 24, substantially nullifies this spring effect of the air.

The Second Embodiment

Figure 2:
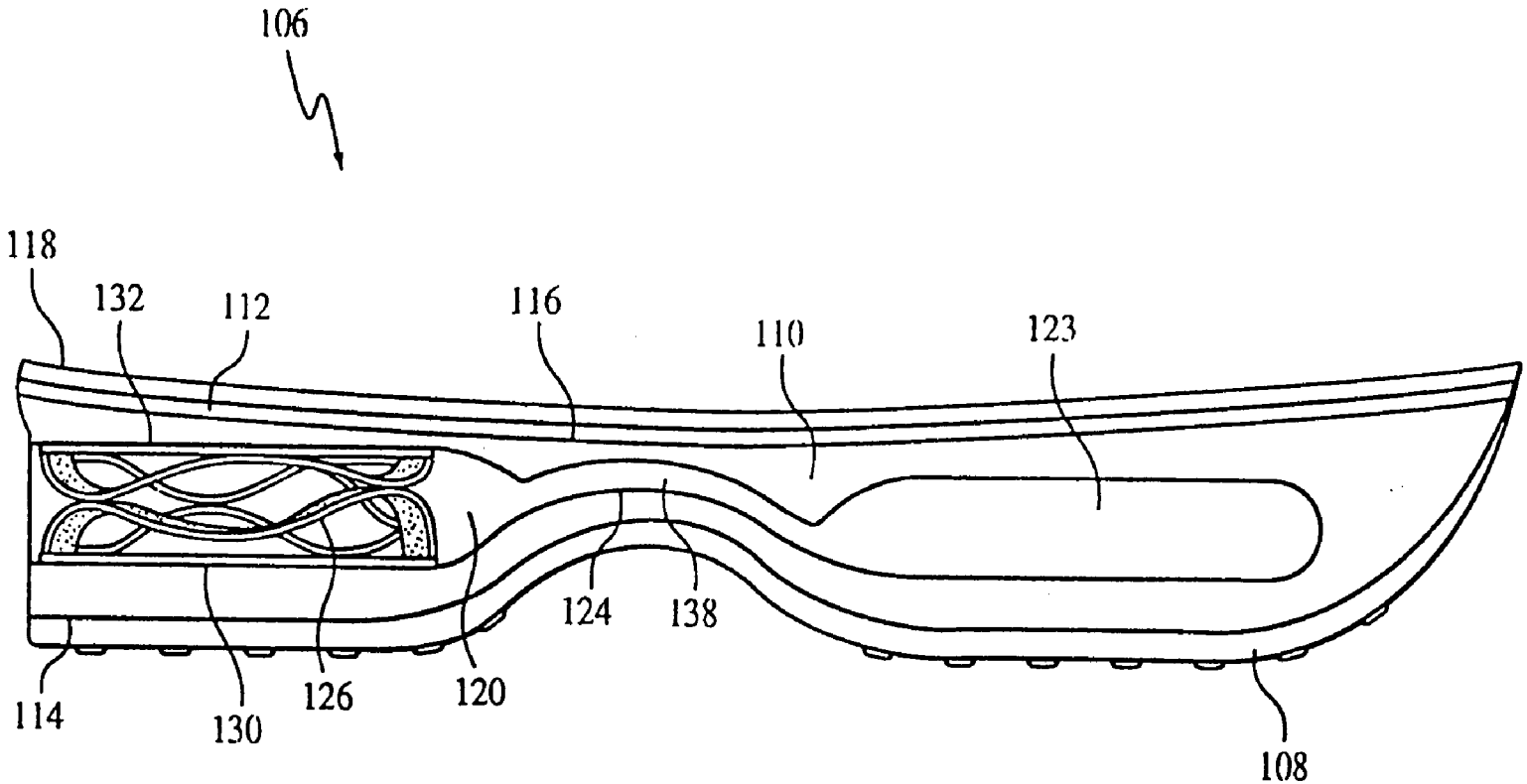
FIG. 2 is a cross sectional side view of an alternative sole assembly for the spring-cushioned shoe of FIG. 1.

Referring to FIG. 2, a fluid shifting sole assembly 106 ("FSSA 106") includes an outer sole 108, a mid-sole 110 and an inner sole 112. Mid-sole 110 has lower and upper surfaces 114 and 116 on the bottom and top of mid-sole 110, respectively. Lower surface 114 is configured for adhesive attachment to outer sole 108, and upper surface 116 is adhesively attached to inner sole 112. Inner sole 112 has a contact surface 118 for adhesive attachment of an upper shoe portion (as shown in FIG. 1).

Mid-sole 110 defines vacuities 120 and 123, located in the heel and ball regions, respectively, of mid-sole 110. As in the first embodiment, the heel vacuity 120 includes polymeric structural plates 130 and 132 at the bottom and top, respectively, of vacuity 120, and a wave spring 126 mounted between plates 130 and 132. Unlike the first embodiment, the ball area vacuity 123 includes no plates or spring. Vacuity 123 is designed to accept fluid displaced from vacuity 120 when vacuity 120 is compressed and reduced in volume by a heel strike.

A passageway 124 connects vacuities 120 and 123, and a fluid 138 is contained within vacuities 120 and 123 and passageway 124. As in the first embodiment, the mid-sole 110 of the second embodiment is hermetically sealed, to prevent fluid 138 from escaping the vacuities and passageway 124, and to prevent air from the exterior of the shoe from entering the vacuities or the passageway. Fluid 138 is, e.g., ambient air at atmospheric pressure.

When an individual wearing a shoe that includes FSSA 106 runs, walks, or jumps, fluid 138 flows back and forth between vacuities 120 and 123, through passageway 124, in the manner described above with respect to the first embodiment.

Since vacuity 123 contains no spring, vacuity 123 can have a smaller volume than vacuity 22 of the first embodiment. In addition, the shape of vacuity 123 can vary more than the shape of vacuity 22, which must be structured to include the spring. In FIG. 2, vacuity 123 is shown having a generally ovular cross-section. However, vacuity 123, can have essentially any shape, including, e.g., irregular shapes with jagged or wavy upper and lower surfaces.

The Third Embodiment

Figure 3:
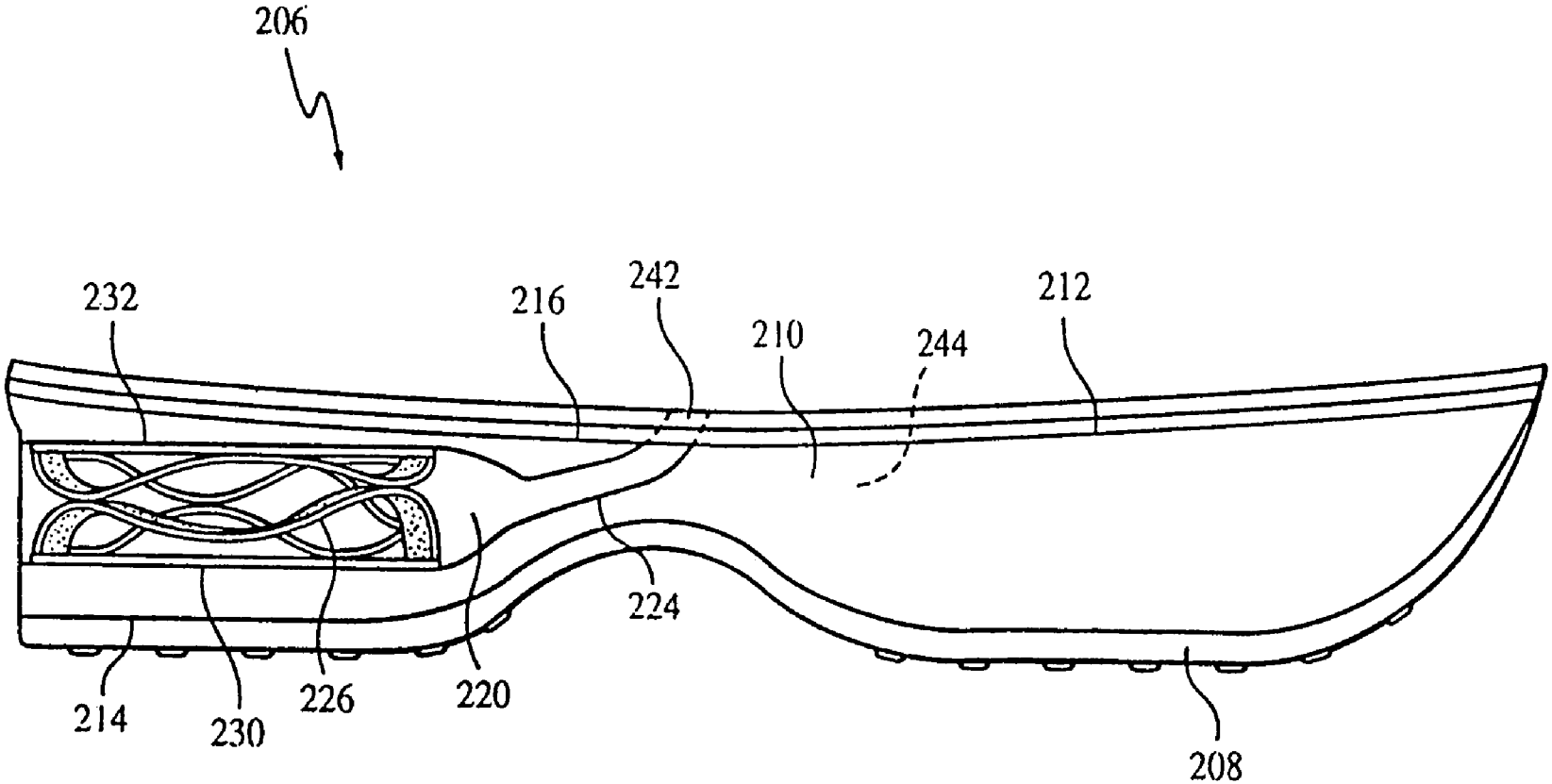
FIG. 3 is a cross sectional side view of another alternative sole assembly for the spring-cushioned shoe of FIG. 1.

Referring to FIG. 3, a third fluid shifting sole assembly 206 ("FSSA 206") includes an outer sole 208, a mid-sole 210, and an inner sole 212. Mid-sole 210 has an upper surface 216 adhesively attached to inner sole 212, and a lower surface 214 attached to the outer sole 208.

As in the first two embodiments, the mid-sole of FSSA 206 defines a vacuity 220 in the heel area. A wave spring 226 is disposed within the vacuity, between lower and upper polymeric structural plates 230 and 232. FSSA 206, however, lacks a ball area vacuity. Instead, a passageway 224 connects heel area vacuity 220 to the exterior of the shoe, through opening 242. In FIG. 3, opening 242 is located along a side 244 of mid-sole 210. Opening 242 can be positioned in other locations, however, so long as it communicates with the exterior of the shoe. Passageway 224 and vacuity 220 have dimensions similar to the dimensions of passageway 24 and vacuity 20.

In operation, when a user's heel strikes the ground and vacuity 220 is compressed, some of the ambient air within vacuity 220 is eructatively expelled from vacuity 220 through passageway 224 and opening 242. When the user's weight is released from the heel, and vacuity 220 returns to normal volume, air re-enters vacuity 220 through opening 242 and passageway 224 until the air pressure in vacuity 220 returns to atmospheric pressure.

Other Embodiments

Other embodiments are possible. For example, instead of crest-to-crest wave springs, other types of compression springs can be used, such as nested wave springs (multi-turn or single turn), interlaced wave springs, or disc springs. The resiliency in the spring can be achieved via bending or torsional dynamic motion, and the springs can have a circular or noncircular cross section. In addition, more than one spring can be located within a vacuity. The springs can be metal, as described above, or can be made from any number of polymers, composites, or other non-metallic materials.

The springs can be mounted within the vacuities in a number of different ways. Structured plates with compression limiting projections can be used, as described above. In addition, the springs can be mounted within the vacuities using the U-shaped clips or plates described in U.S. Pat. No. 6,282,814. Alternatively, the vacuities can be configured to receive the springs without plates, using, e.g., void volumes as described in U.S. Pat. No. 6,282,814. Other methods of mounting springs can also be used.

The shoe soles can have additional vacuities. For example, the soles can have multiple vacuities in the heel region, each with a compression spring (or some with springs, and some without). The various vacuities can all be connected by a system of ducts or passageways. Multiple ball area vacuities are also possible.

In the embodiments with one heel vacuity and one ball area vacuity, more than one passageway can connect the two vacuities. Similarly, in embodiments with passageways connecting a vacuity to the exterior, multiple passageways and multiple exits can be included. In addition, the concepts of the first and third embodiments can be combined. For example, in the first embodiment, additional passageways can be included that connect vacuities 20 and 22 to the exterior of the shoe.

The shoe need not include a separate inner sole, outer sole, and mid-sole. For example, the sole can be made from one or two layers, rather than three. The vacuities can be defined within any part of the sole assembly.

In embodiments where the vacuities are hermetically sealed from the outside environment, such as the first and second embodiments, the vacuities can be sealed with the air within the vacuities at less than atmospheric pressure. To seal the vacuities at less than atmospheric pressure, some air is removed from the vacuity before the vacuity is sealed. For example, the vacuity (and the spring inside) can be placed under a load, compressing both the vacuity and the spring, and forcing air out of the vacuity. While the vacuity and spring are under load, the inner sole and mid-sole are sealed, sealing the vacuity. The load is then released, and the spring expands, causing the vacuity to expand in volume, with the air inside at less than atmospheric pressure. With less air (and therefore less air pressure) inside the vacuity, the spring effect of the air is further reduced. The pressure can be reduced to the point that the compression spring would have to be compressed well beyond its design limit before the air trapped inside the vacuity exhibits more than an insignificant spring effect. For example, the pressure in a vacuity can be reduced to −2 psig (i.e., 2 psi less than atmospheric pressure). The same process could be used when sealing more than one vacuity.

Fluid other than ambient air can be used within sealed vacuities. The vacuities could be sealed with pure gasses, such as nitrogen or helium inside, or even with a liquid inside.

A number of embodiments of the invention have been described. Nevertheless, it will be understood that various modifications may be made without departing from the spirit and scope of the invention. Accordingly, other embodiments are within the scope of the following claims.

The invention claimed is:

1. A shoe having an exterior surface comprising:

a shoe sole having a ball region and a heel region and defining a vacuity;

a spring disposed within said vacuity;

at least one opening in said exterior surface;

a fluid passageway providing fluid communication between said vacuity and said at least one opening in said exterior surface, said passageway configured to allow eructative evacuation of fluid from said vacuity to said exterior of said shoe upon a reduction in volume of said vacuity, said at least one opening providing an outlet from and an inlet to said fluid passageway and said vacuity.

2. The shoe of claim 1 wherein said vacuity is located in said ball region of said sole.

3. The shoe of claim 1 wherein said vacuity is located in said heel region of said sole.

4. The shoe of claim 1 wherein said spring is a crest-to-crest multi-turn wave spring.

5. The shoe of claim 1, wherein the shoe sole comprises an inner sole, a mid-sole, and an outer sole, wherein the mid-sole defines the vacuity.

6. The shoe of claim 1 wherein said at least one opening is defined in the side of said exterior of said shoe.

* * * * *